US006388402B1

(12) United States Patent
De Jong et al.

(10) Patent No.: US 6,388,402 B1
(45) Date of Patent: May 14, 2002

(54) COMPENSATION OF CRT DEFLECTION ERRORS WITH FOURFOLD SYMMETRICAL MAGNET SYSTEMS

(75) Inventors: Marteijn De Jong, Eindhoven; Ewoud Vreugdenhil, Dommelen; Jacobus H. T. Jamar, Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/414,462

(22) Filed: Oct. 7, 1999

(30) Foreign Application Priority Data

Oct. 26, 1998 (EP) ..... 98203591

(51) Int. Cl.[7] ..... G09G 1/28

(52) U.S. Cl. ..... 315/368.28; 315/370; 313/413; 313/461

(58) Field of Search ..... 315/368.28, 370, 315/371; 313/409, 413, 415, 461

(56) References Cited

U.S. PATENT DOCUMENTS 5,488,270 A * 1/1996 Takita et al. ..... 315/370
5,668,447 A * 9/1997 Okuyama et al. ..... 315/368.28
5,801,496 A * 9/1998 Takita ..... 315/370
5,923,131 A * 7/1999 Ishii ..... 315/370
6,097,163 A * 8/2000 Chauvinh et al. ..... 315/368.28

FOREIGN PATENT DOCUMENTS

EP 0187964 A1 7/1986 ..... H01J/29/68

* cited by examiner

*Primary Examiner*—Don Wong
*Assistant Examiner*—Thuy Vinh Tran

(57) ABSTRACT

Color picture display device comprising a cathode ray tube and a deflection unit. The picture display device comprises compensation means for compensating picture errors. The compensation means is arranged on a side of a deflection unit facing the display screen and comprises four magnet systems which are arranged fourfold symmetrically with respect to the tube axis and extend through an angle α ranging between 24 and 34 degrees or between 40 and 48 degrees.

5 Claims, 4 Drawing Sheets

COMPENSATION OF CRT DEFLECTION ERRORS WITH FOURFOLD SYMMETRICAL MAGNET SYSTEMS

BACKGROUND OF THE INVENTION

The invention relates to a color picture display device comprising a cathode ray tube, a means for generating three electron beams, a display screen and a deflection unit for generating deflection fields for deflecting the electron beams across the display screen, provided with compensation means which extend in front of the deflection plane of the deflection unit and are used for compensating picture errors.

The invention also relates to a deflection unit for a cathode ray tube.

A picture display device of the type described in the opening paragraph and a deflection unit of the type described in the second paragraph are known from European patent specification EP 0 187 964. On its side facing the display screen, the known deflection unit is provided with a system of permanent magnets so as to compensate picture errors. The system comprises four main bar magnets and eight smaller adjustable magnets. The adjustable magnets may be rotated for the purpose of fine-tuning.

The drawback of the known picture display device and deflection unit is that the design is complicated and the adjustment of the fine-tuning magnets is a time-consuming process.

It is an object of the invention to provide a picture display device allowing a simplified design of the picture display device and deflection unit.

To this end, the picture display device according to the invention is characterized in that the compensation means comprise four magnet systems which, by approximation, are arranged fourfold symmetrically with respect to the tube axis, and in which each magnet system, viewed from the tube axis, extends through an angle ranging between 24 and 34 degrees or between 40 and 48 degrees.

The invention is based on the recognition that magnet systems placed in front of the deflection plane, for example, on the side of the deflection unit facing the display screen, may have a positive effect on picture errors, but may generally introduce picture errors in their turn.

Fourfold symmetrical is herein understood to mean that the magnetic fields of each magnet system are approximately equal, be it that the magnetic fields, when taking the tube axis (or the axis of symmetry of the deflection unit) as a reference, differ in strength and direction to such an extent that they merge with each other around said axis due to a rotation through an angle of 90 degrees. By using four magnet systems which, by approximation, are arranged fourfold symmetrically with respect to the tube axis (or axis of symmetry of the deflection unit), the following aspect occurs.

Due to the symmetrical arrangement, the common magnetic field generated by the magnet systems (and hence the field generated by the compensation means) can comprise only 4, 8, 12, 16 poles, etc. The four magnet systems comprise two pairs of magnet systems, for example, an east-west pair and a north-south pair. The 4-pole, 12-pole and 20-pole fields generated by each pair have opposite signs and cancel each other. As a result, the magnet field generated by the compensation means comprises only 8-pole, 16-pole, 24-pole, etc. components. The compensation means notably generate a magnetic field which, in addition to a desired 8-pole with which picture errors can be compensated, comprises also higher-order components. These higher-order components, notably 16 and 24-pole components, cause unwanted picture errors. These higher-order components in the magnetic field increase the sensitivity to tolerances in dimensioning and positioning and residual errors such as variations in the triorotation error across the display screen.

The consequences of the unwanted higher-order components in the magnetic field generated by the magnet systems may be alleviated by placing the magnet systems further away from the tube axis. However, this also results in the necessity of using stronger magnet systems so as to achieve the desired positive effect, which increases costs, may affect proximate further elements of the color display device and increases the size of the deflection unit.

The consequences of the unwanted higher-order effects may also be alleviated by using fine-tuning magnets as described in the European patent specification cited hereinbefore. However, these fine-tuning magnets are expensive, complicate the design, must be adjustable and, moreover, should be fixed after their adjustment.

SUMMARY OF THE INVENTION

The invention provides an improved picture display device of the type described in the opening paragraph.

The invention is based on the recognition that the strengths of higher-order components in the magnetic field generated by the magnet systems can be minimized by suitable choice of the design of the magnet systems so that the negative effects caused by the magnet systems are reduced without reducing the strength of the desired component and hence the positive effect of the magnet systems.

Each higher-order component has a design for which the strength of the higher-order component is minimal. The strength of the 16-pole component is theoretically minimal for four magnet systems each extending through an angle of 45 degrees, the strength of the 24-pole component is theoretically minimal at 30 degrees. Generally, the strength of the 16-pole component is very small if the magnet systems extend through an angle ranging between 40 and 48 degrees. The strength of the 24-pole component is very small if the magnet systems extend through an angle ranging between 24 and 34 degrees.

The magnet systems preferably extend through an angle ranging between 24 and 34 degrees, preferably between 28 and 30 degrees. The component having the highest order is then minimized and the length of the magnet systems is shorter than in the range between 40 and 48 degrees, which reduces the risk of the magnet systems affecting other elements of the deflection unit and/or color display device, such as the IMS (Internal Magnetic Shield).

Within the scope of the invention, the magnet systems may be formed by electromagnets each comprising, for example, a coil and an elongate core, but the compensation means preferably comprise four permanent magnets of equal size and strength.

These and other aspects of the invention are apparent from and will be elucidated with reference to the embodiments described hereinafter.

BRIEF DESCRIPTION OF THE DRAWING

In the drawing.

The Figures are not to scale. Generally, identical components in the Figures are denoted by the same reference numerals.

DESCRIPTION OF THE PREFERRED EMBODIMENTS

Figure 1:
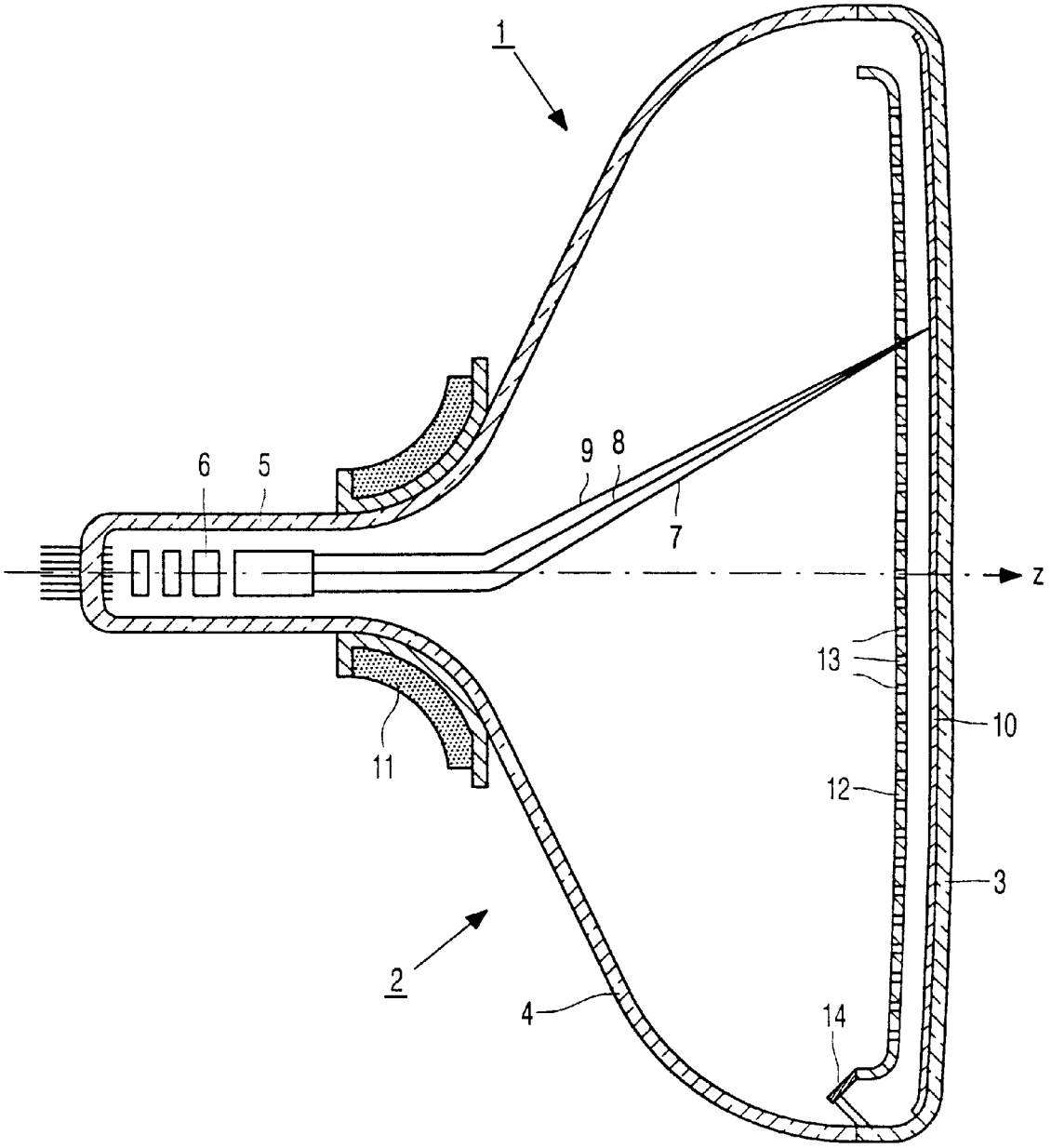
FIG. 1 shows a picture display device.

Color picture display device 1 (FIG. 1) comprises an evacuated envelope 2, a display window 3, a cone 4 and a neck 5. The neck 5 accommodates an electron gun 6 for generating three electron beams 7, 8 and 9. A display screen 10 is present on the inner side of the display window. The display screen 10 comprises a phosphor pattern of red, green and blue-luminescing phosphor elements. On their path to the display screen, the electron beams 7, 8 and 9 are deflected across the display screen 10 by means of deflection unit 11 and pass a shadow mask 12 which comprises a thin plate with apertures 13 and is arranged in front of the display window 3. The shadow mask is suspended in the display window with suspension means 14. The three electron beams converge and pass the apertures of the shadow mask at a small angle with respect to each other and, consequently, impinge only upon phosphor elements of one color.

Figure 2:
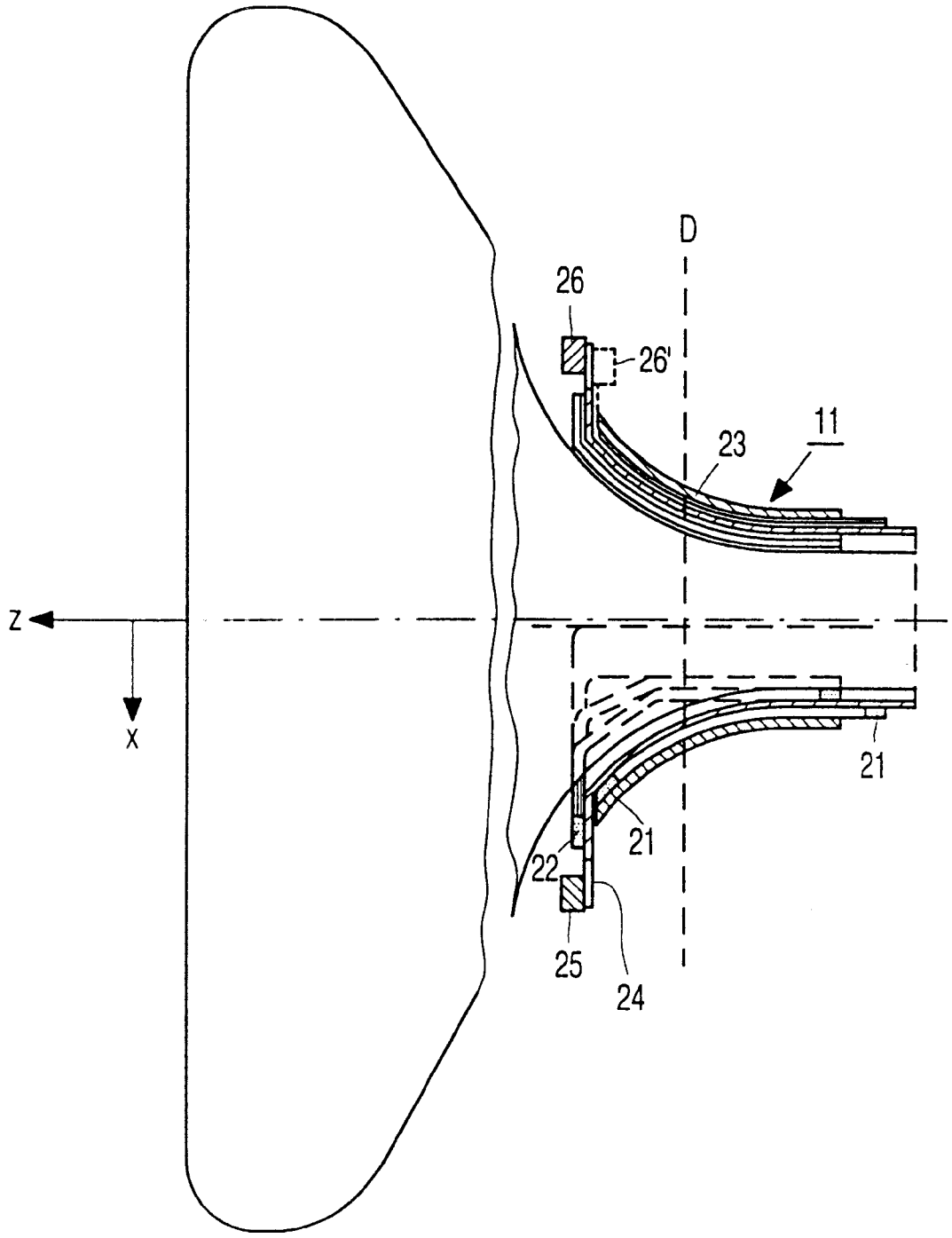
FIG. 2 is a cross-section of a deflection unit according to the invention.
Figure 3:
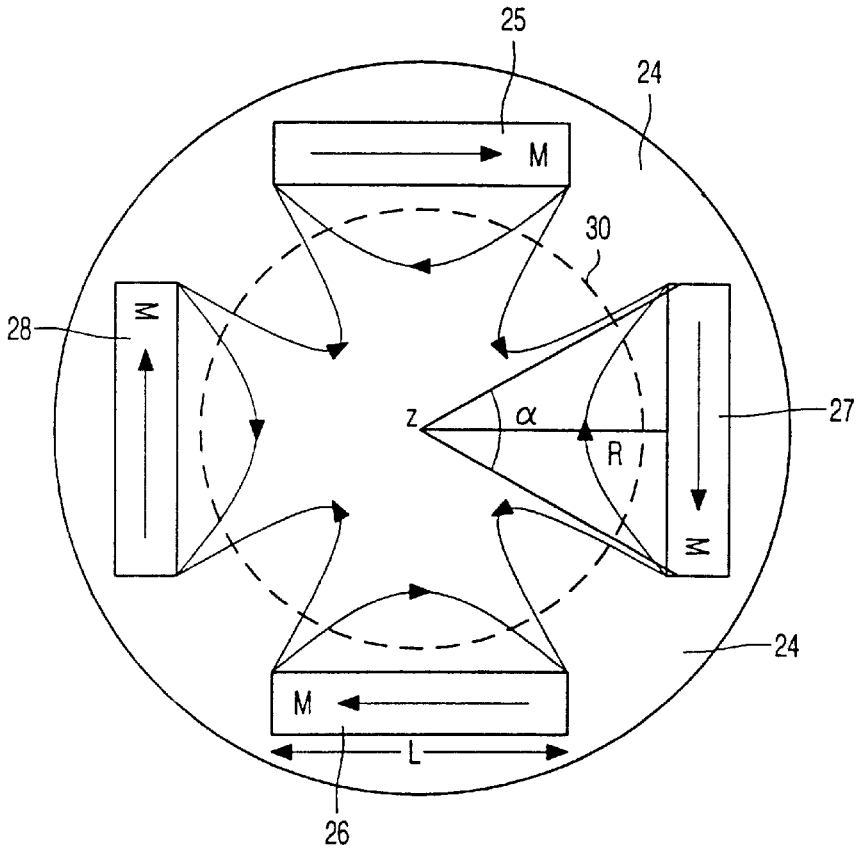
FIG. 3 is a front elevational view of a deflection unit with compensation means.
Figure 4A:
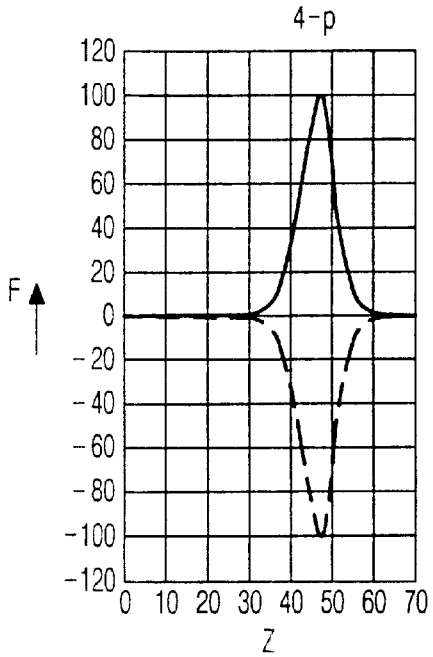
FIGS. 4A to 4F show graphs illustrating the strength of a plurality of components of the magnetic field generated by a compensation means according to the invention.
Figure 4B:
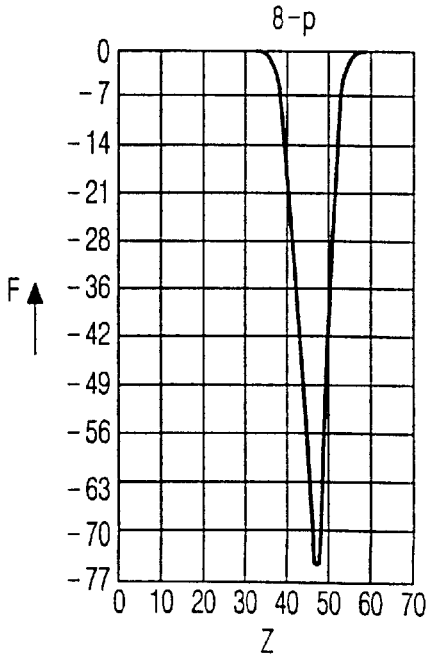
Figure 4C:
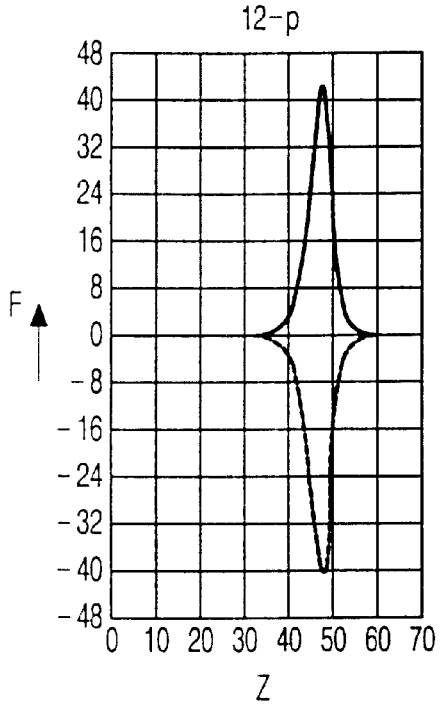
Figure 4D:
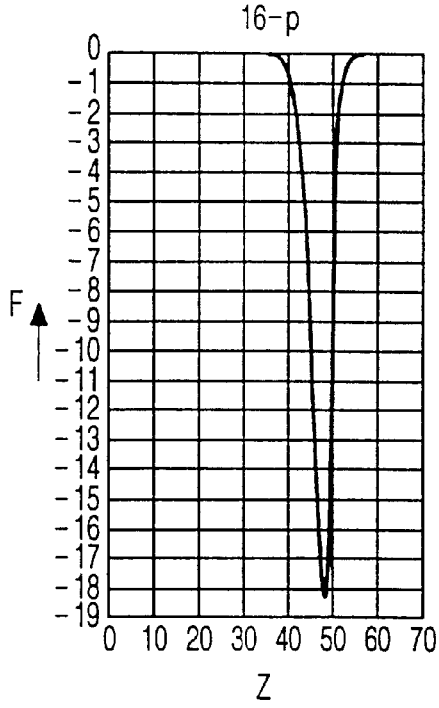
Figure 4E:
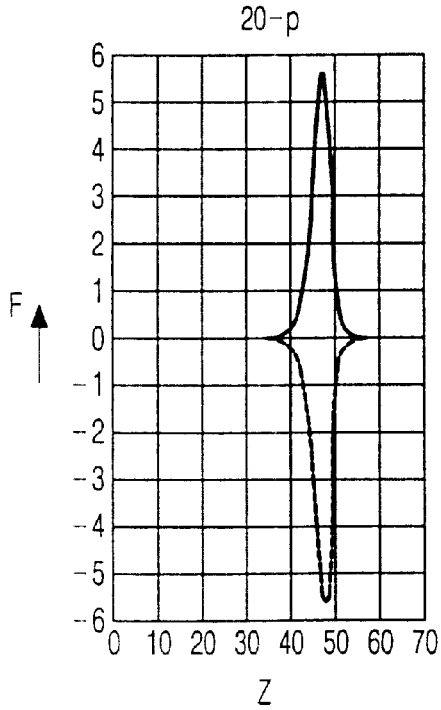
Figure 4F:
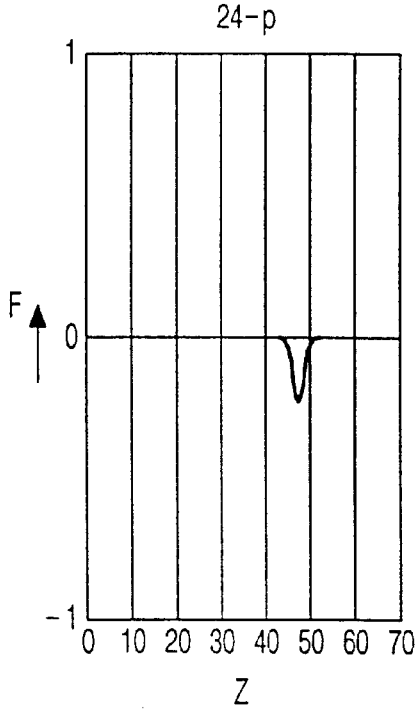

FIG. 2 is a cross-section of a deflection unit according to the invention. The deflection unit comprises two deflection coil systems 21 and 22 for deflecting the electron beams in two mutually perpendicular directions (x and y directions). In this embodiment, the deflection unit further has a yoke ring 23. The yoke ring is made of a soft-magnetic material. The deflection plane D is indicated. This is the plane in which the deflection point of the electron beams is located. If there is a variation of the deflection plane (i.e. the z position of the deflection plane is slightly dependent on the deflection angle), the deflection plane as understood within the scope of the present invention is then the z position within said variation located closest to the electron gun. The deflection unit 11 has a side 24 facing the display screen 3 (which side is constituted by a flange in this embodiment) which is provided with a plurality of magnet systems 25, 26, 27 and 28. The magnet systems are preferably placed on the part of side 24 facing the display screen. However, this should not be considered as limitative. They may be alternatively placed on the "rear part" of side 24 (as indicated by system 26'). The magnet systems may be alternatively placed on separate rings secured to the flange 24. FIG. 3 shows side 24 in a front elevational view, with the four magnet systems 25, 26, 27 and 28. The four magnet systems are arranged fourfold symmetrically, i.e. the systems approximately merge due to a rotation through 90 degrees around the z axis (the tube axis). The magnetic field formed by the compensation means therefore remains equal at a rotation through 90 degrees around the z axis. To realize this, the four magnet systems are preferably approximately equal in size and strength. When permanent magnets are used, this means that the strength and length of the magnets are approximately equal. The angle $\alpha$ through which the magnet systems extend is shown. This angle ranges between 40 and 48 degrees or between 28 and 30 degrees. A broken line 30 also indicates the outer circumference of the envelope 2 in the plane through the magnet systems 25, 26, 27 and 28, the distance R between the tube axis and a magnet system, and the length L of a magnet system. The conditions of the present invention may not only be expressed as an angle but also as follows.

$$R/L = \left[2 \cdot \tan\left(\frac{2\pi}{n}\right)\right]^{-1},$$

in which n=16 or n=24 or n=30.

The strength of the 16-pole component is theoretically minimal for four magnet systems each extending through an angle of 45 degrees, the strength of the 24-pole component is theoretically minimal at 30 degrees. Generally, the strength of the 16-pole component is very small if the magnet systems extend through an angle ranging between 40 and 48 degrees. The strength of the 24-pole component is very small if the magnet systems extend through an angle ranging between 24 and 34 degrees.

The magnet systems preferably extend through an angle ranging between 24 and 34 degrees, preferably between 28 and 30 degrees. The component having the highest order is then minimized and the length of the magnet system is shorter than in the range between 40 and 48 degrees, which reduces the risk of the magnet systems affecting other elements of the deflection unit and/or color picture display device, such as the IMS (Internal Magnetic Shield). The magnet systems preferably comprise two pairs of magnets placed north-south (below and above the in-line plane) and east-west.

FIGS. 4A to 4F are graphs showing the strength F of different components of the magnetic field (4, 8, 12, 16, 20 and 24-pole components denoted by 4-P, 8-P, etc.) generated on the z axis as a function of the z position (in which z=48 mm corresponds to a plane through the magnets 25, 26, 27 and 28 shown in FIG. 3) for a compensation means as shown in FIG. 3, in which R=72 mm and L=36 mm, which corresponds to an angle $\alpha$ of 28 degrees. The strength of the components of the magnetic field is plotted on the vertical axis and the z position is plotted on the horizontal axis. Each Figure shows two strengths, namely the north-south magnets (broken lines) of magnets 25 and 26 and the east-west magnets (solid lines) of magnets 27 and 28. The field strength is the sum of the values for these lines. The broken and solid lines indicate values for the 4, 12 and 24-pole components which are equal in magnitude but have opposite signs, so that the total field strength is zero. It is evident that the 24-pole component is negligibly small. At an angle of 28.6 degrees, the strength of the 24-pole component is an order of magnitude smaller. The angle at which the minimum value for the 24-pole component is reached is 14.3 degrees. The difference between 15 degrees, as mentioned above, and 14.3 degrees, as mentioned here, resides in the fact that the 24-pole component is zero in accordance with the calculations if these calculations are based on idealized magnets in which the poles of the magnets are indicated as points. Actually, the poles of the magnets have finite dimensions. If this is taken into account in the calculations, the "zero" (minimum value for the 24-pole component) is slightly below 15 degrees, namely 14.3 degrees.

The invention has the following advantages.

Display tubes can be better corrected for picture errors, notably triorotation errors;

Complicated adaptations are either not necessary, or there is less cause for adaptations of the deflection unit or display device;

Reduced sensitivity to tolerances;

Fewer picture error variations such as triorotation as a function of the position on the screen (residual errors).

It will be evident that many variations are possible within the scope of the invention.

For example, the magnet systems shown are straight. This should not be considered as being limitative. The magnets may be alternatively arc-shaped.

What is claimed is:

1. A color picture display device comprising a cathode ray tube, a means for generating three electron beams, a display screen and a deflection unit for generating deflection fields for deflecting the electron beams across the display screen, provided with compensation means which extend in front of the deflection plane of the deflection unit and are used for compensating picture errors, characterized in that the compensation means comprises four magnet systems which, by approximation, are arranged fourfold symmetrically with respect to the tube axis, and in which each magnet system, viewed from the tube axis, extends through an angle ranging between 24 and 34 degrees or between 40 and 48 degrees.

2. A color picture display device as claimed in claim 1, characterized in that the magnet systems extend through an angle ranging between 24 and 34 degrees.

3. A color picture display device as claimed in claim 2, characterized in that the magnet systems extend through an angle ranging between 28 and 30 degrees.

4. A color picture display device as claimed in claim 1, characterized in that the compensation means comprise four permanent magnets of a approximately equal size and strength.

5. A deflection unit for a color picture display device, provided with compensation means which extend in front of the deflection plane of the deflection unit and are used for compensating picture errors, characterized in that the compensation means comprises four magnet systems which, by approximation, are arranged fourfold symmetrically with respect to the tube axis, and in which each magnet system, viewed from the tube axis, extends through an angle ranging between 24 and 34 degrees or between 40 and 48 degrees.

* * * * *